US005530457A

United States Patent [19]

Helgeson

[11] Patent Number: 5,530,457

[45] Date of Patent: Jun. 25, 1996

[54] PARTITIONED DISPLAY APPARATUS

[75] Inventor: Michael A. Helgeson, Eagan, Minn.

[73] Assignee: Honeywell Inc., Minneapolis, Minn.

[21] Appl. No.: 511,033

[22] Filed: Aug. 3, 1995

Related U.S. Application Data

[63] Continuation of Ser. No. 391,826, Feb. 21, 1995, abandoned, which is a continuation of Ser. No. 151,457, Nov. 9, 1993, abandoned.

[51] Int. Cl.[6] ..... G09G 5/00

[52] U.S. Cl. ..... 345/185; 345/1; 345/190; 345/193; 345/201

[58] Field of Search ..... 345/1, 103, 148, 345/187, 189, 190, 201, 203, 143, 185

[56] References Cited

U.S. PATENT DOCUMENTS

| | | | |
|---|---|---|---|
| 4,386,349 | 5/1983 | Granberg et al. | 345/203 |
| 4,740,786 | 4/1988 | Smith | 345/3 |
| 4,980,765 | 12/1990 | Kudo | 345/203 |
| 5,162,787 | 11/1992 | Thompson | 345/32 |
| 5,317,334 | 5/1994 | Sano | 345/148 |

FOREIGN PATENT DOCUMENTS

| | | |
|---|---|---|
| 0258560 | 9/1988 | European Pat. Off. . |
| 0488891 | 3/1992 | European Pat. Off. . |
| 0541978 | 5/1993 | European Pat. Off. . |
| 2660471 | 4/1991 | France . |
| 9319452 | 9/1993 | WIPO . |

OTHER PUBLICATIONS

Electronic Design, vol. 38, No.10, 24 May 1990, Hasbrouck Heights, New Jersey US–pp. 37–43 D. Bursky "Triple–port Dynamic RAM accelerates data movement" see the whole article.

IBM Technical Disclosure Bulletin, vol. 33, No. 3A, Aug. 1990, New York US pp. 403–404 "Fiber Optic Single Fiber Interface for Monochrome LCD Display".

*Primary Examiner*—Richard Hjerpe
*Assistant Examiner*—Kent Chang
*Attorney, Agent, or Firm*—John G. Shudy, Jr.

[57] ABSTRACT

A display apparatus for displaying video information received from a plurality of memory devices. Each memory device is organized as $2^x$ rows by $2^y$ columns of memory locations and a plurality of bits deep, where x and y are integers. The display apparatus includes a display having a plurality of display devices wherein each display device includes a plurality of pixels. The plurality of pixels of at least one of the display devices is organized as $2^n$ rows by $2^m$ columns of pixels as a function of the memory device organization, where n and m are integers. The display apparatus further includes apparatus for receiving the video information from the plurality of memory devices and driving at least a portion of the plurality of pixels of each display device in parallel.

7 Claims, 8 Drawing Sheets

PARTITIONED DISPLAY APPARATUS

This application is a continuation, of application Ser. No. 08/391,826, filed Feb. 21, 1995, now abandoned, which is a continuation of application Ser. No. 08/151,457, filed Nov. 9, 1993, now abandoned.

FIELD OF THE INVENTION

The present invention relates to display systems. More particularly, the present invention pertains to partitioned displays for display systems, in particular, high resolution partitioned displays.

BACKGROUND OF THE INVENTION

With the advancement of fabrication technology, the resolution of active matrix electroluminescent displays (AMEL displays) and active matrix liquid crystal displays (AMLCD's) steadily has increased. However, use of such displays is limited by the rate at which video data can be transmitted from a video data source to the display. For example, with video entering a graphics memory at 30 frames per second (fps) to 60 fps, to maintain a desired state of a display, each pixel of the display must be electrically refreshed at least 30 to 60 times a second. The greater the resolution of a display, the greater the number of rows and columns of pixels that must be refreshed at a time, for example, at resolutions of 1280×1024 pixels, 30 fps to 60 fps would require 40–80 million pixels per second into and out of the graphics memory. Therefore, a need exists for a display architecture capable of transmitting the video data to the displays at high resolution display rates.

In addition, with a multitude of displays and display pixel formats available, numerous memory architecture designs are required to transmit video data between the video source and display for a multitude of display formats. With particular memory architectures designed for use with particular types of displays and display formats, such architectures are not interchangeable for use with a multitude of display formats. In many circumstances it would be beneficial to be able to utilize a memory architecture for two or more display formats. Thus, a need for such a memory architecture is apparent.

SUMMARY OF THE INVENTION

The present invention provides a display apparatus for displaying video information received from a plurality of memory devices. Each memory device is organized as $2^x$ rows by $2^y$ columns of memory locations and a plurality of bits deep, where x and y are integers. The display apparatus includes a display having a plurality of display devices, each display device having a plurality of pixels. The plurality of pixels of at least one of the display devices is organized as $2^n$ rows by $2^m$ columns of pixels as a function of the memory device organization, where n and m are integers. The video information is received from the plurality of memory devices and at least a portion of the plurality of pixels of said each display device are driven in parallel.

A method in accordance with the present invention includes configuring a display apparatus. The method includes the steps of selecting a memory architecture. The memory architecture selected includes $2^x$ rows of memory space organized by $2^y$ columns and a plurality of bits deep, m and n being integers. A display is then partitioned into a plurality of pixels slices. Each pixel slice includes a plurality of pixels. An organization and number of said plurality of pixels of each of the pixel slices is selected as a function of the organization of the memory architecture.

In one embodiment of the invention, the memory architecture includes video random access memory, in particular, triple ported video random access memory.

DESCRIPTION OF THE PREFERRED EMBODIMENT

Figure 1A:
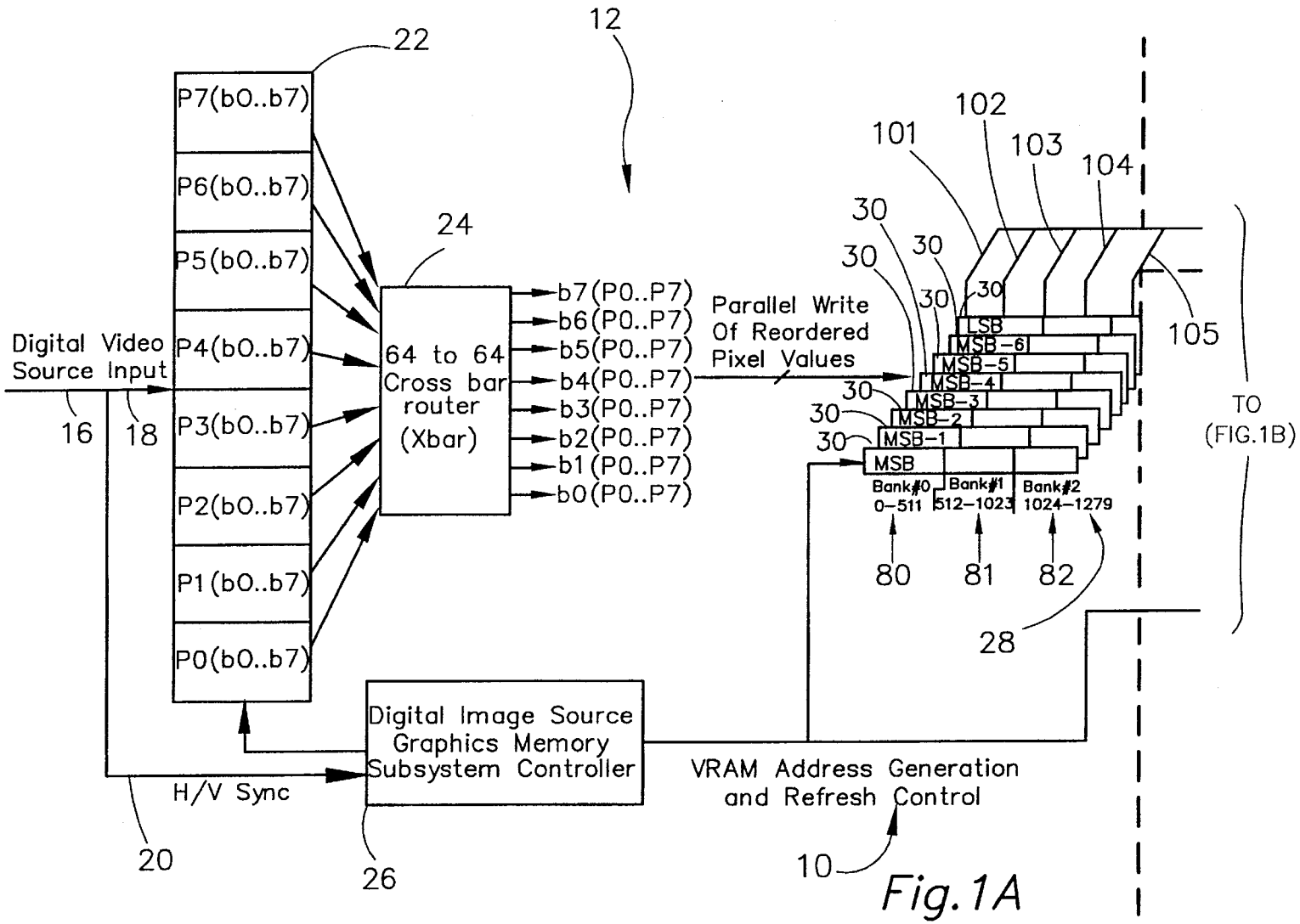
FIG. 1A and 1B are block diagrams of a display system in accordance with the present invention.

In general terms, a display system 10 in accordance with the present invention shall be described with reference to FIG. 1. Pixel data 18 is received by a reconfigurable memory architecture 12 from a digital video source 16. Under control of a subsystem controller 26, the pixel data 18 is accumulated by accumulator 22 and either buffered or reordered depending upon the desired programming of cross bar router 24. The reordered or buffered pixel data is then written in parallel to frame buffer 28. Frame buffer 28 includes a certain number of standard video random access memory devices (VRAM's). A VRAM device is organized as $2^x$ rows by $2^y$ columns and a number of bits deep. The pixel data is then written from the frame buffer 28 to digital display apparatus 14 via interconnect 13.

Display apparatus 14 includes display 32 which in the preferred embodiment is a 1280 column×1024 row resolution display and which is vertically partitioned into pixel slices 34 to match the VRAM organization. The pixel slices 34 are sized as a function of $2^n \times 2^m$, where n and m are integers. Generally, the display 32 is partitioned according to q ($2^n \times 2^m$) where q is the number of pixel slices, n is the horizontal or column pixel power, and m is the vertical or row pixel power; in FIG. 1, q=5, n=8 and m=10.

In some cases, as for HDTV, a display may not have pixel rows or columns sized as a function of 2. In such cases, excess pixels which overflow the desired q ($2^n \times 2^m$) arrangement are placed in a remainder slice and may be compensated for by appropriate control of data routing and storage 39. For example, if the display has a resolution of 1900×1024, there would be seven slices and a remainder slice of 108 horizontal pixels. For simplicity, a display having an organization as a function of 2 shall be utilized for describing the invention herein, but one skilled in the art will recognize that the present invention can be applied to any display resolution.

With the display 32 vertically partitioned, data lines are allocated to each vertical pixel slice 34 such that the number of data lines is evenly divisible into the number of horizontal pixels of each slice. In FIG. 1, a group 38 of eight data lines 36 is allocated to each pixel slice having 256 horizontal pixels and 1024 vertical pixels. The pixel data is then written from the frame buffer 28 in parallel to the vertical slices 34 of display 32 via interconnect 13 and the groups 38 of data lines 36 by data routing and storage circuitry 39.

The partitioning and reconfigurable memory architecture provides the flexibility for various pixel write formats as used with AMEL displays, AMLCD's, and other display types such as field emitter array (FEA) displays and charge transfer type displays. Data routing and storage 39, which may include data multiplexing, shifting, latching, conversion, loading and overflow compensation, is unique to each image display 32. The number of VRAM's required in the present invention is substantially reduced over conventional memory architecture for high resolution displays as interconnect compatibility is maintained between the VRAM's and the vertically partitioned display 32.

The combination of the reconfigurable memory architecture 12 and display apparatus 14 provides the ability to acquire new image data at 60 plus fps and refresh the image display at 60 plus fps. In addition, with inclusion of the cross bar router 24 prior to the frame buffer 28, different types of image displays can be refreshed in temporal bit-plane field fashion, bit plane row fashion or by a raster, pixel by pixel, technique as described further below.

Digital display system 10 shall now be described in further detail with reference to FIGS. 1 and 2. Digital display system 10 includes reconfigurable memory architecture 12, interconnect 13 and integrated digital display apparatus 14. Reconfigurable memory architecture 12 includes accumulator 22, cross bar router 24, digital image source graphics memory subsystem controller 26 and frame buffer 28. Display apparatus 14 includes allocated groups 38 of data lines 36, data routing and storage 39, and vertically partitioned pixel slices 34 of display 32. One embodiment of display apparatus 14 is shown by digital display apparatus 50 of FIG. 3.

Reconfigurable memory architecture 12 and partitioned display apparatus 14 provide the ability to acquire pixel data at 60 plus fps and refresh an image display at 60 plus fps. The reconfigurable memory architecture 12 allows for refreshing different types of image displays in both temporal bit-plane field or bit-plane row fashion, in addition to a raster technique. Accumulator 22 of reconfigurable memory architecture 12 receives pixel data 18 from the video source 16 in a sequential fashion, i.e., row0-p0, p1,p2,p3, . . . ,p1279; row1-p0,p1,p2,p3, . . . ,p1279; etc . . . to row 1023-p0,p1, p2,p3, . . ,p1279, from a non-interlaced source, or row0-p0, p1,p2, . . . p1279; row2-p0,p1,p2, . . . p1279; . . . ; row1023-p0,p,1p,2, . . . p1279; row1-p0,p1,p2, . . . p1279; row3-p0,p1,p2. . . p1279; . . . ;row1023-p0,p1,p2, . . . ,p1279, from an interlaced source, for a vertically partitioned 1280×1024 display 32. For simplicity, the remaining description shall be with regard to a non-interlaced source.

The digital video source 16 is a standard source with horizontal and vertical synchronization periods 20 as known to one skilled in the art. As the pixel data for each pixel is sequentially received, the pixel data for eight pixels P0-P7 is accumulated on a by-pixel basis, i.e., P0(b0. . . b7), Pl(b0. . . b7), . . . P7(b0. . . b7), etc. The pixel data accumulated for the eight consecutive pixels P0-P7 is either buffered or reconfigured by crossbar router or switch 24 from a by-pixel basis to a bit-plane basis depending on the programmed configuration of the crossbar router 24. For example, with regard to temporal bit-plane field or bit-plane row refresh techniques, the information enters the 64 to 64 crossbar router 24 sequentially for each pixel and is output from crossbar router 24 on a by bit-plane basis, i.e., b0(P0...P7), b1(P0. . . P7). . . b7(P0. . . P7), etc. For raster refresh techniques, the crossbar router is programmed to pass through the pixel data on a by-pixel basis so the display apparatus can be refreshed in a raster fashion. Crossbar router or switch 24 is a standard off the shelf programmable circuit, such as the L64270 available from LSI Logic Corporation, Milpitas, Calif.

The programmability allows the reordering of the pixel data in many different manners to match the type of display and pixel format utilized and manner in which the display is refreshed. As discussed above, reordering the pixel data from a raster, pixel-by-pixel, basis to a by bit-plane field basis allows for temporal gray scale techniques with a display as discussed below. On the other hand, if the crossbar router 24 is programmed to allow the pixel data to pass through the crossbar router 24 on a raster, pixel-by-pixel basis, a raster pixel format is provided for a display such as an AMEL display, an AMLCD, FEA display, etc. By inserting the functionality of a cross-bar router, numerous bit orders for specific displays could be accomodated. If a multitude of reordering possibilities is not required, the desired reordering can be hard-wired.

A parallel write of the reordered pixel data is then performed from crossbar router 24 to frame buffer 28. In the embodiment of FIG. 1, all eight bits of the 8-bit pixel are selected for transmission to the vertically partitioned display 32. One skilled in the art will readily recognize that although the description herein pertains to the transmission of eight bits for each pixel to display 32, five bits could be selected and utilized or any other variation of the number of bits per pixel could be utilized. For example, different bits per pixel are utilized when dealing with color and monochrome displays and different bit-level gray scales. If dealing with color, 24 bits could be transmitted per pixel.

Frame buffer 28, in the preferred embodiment, for service of vertically partitioned 1280×1024 AMEL or AMLCD display 32 utilizes twenty-four VRAM's with dual 256×8 serial access memory ports, such as MT43C8128 128K×8 devices available from Micron Technology Inc., Boise, Id. The VRAM devices 30 are organized into three banks, Bank #0 (80), Bank #1 (81) and Bank #2 (82). Bank #0 (80) services slice #0 and slice #1 of vertically partitioned display 32. Bank #1 (81) services slice #3 and slice #4 of vertically partitioned displays 32. Bank #2 (82) services only slice #5. If the display had overflow pixels as previously described, Bank #2 (82) would service this overflow slice as well. These VRAM devices 30 act as double buffered, triple ported VRAM devices organized as $2^x \times 2^y$, where x and y are integers. More particularly, the VRAM's are organized, as shown by the double buffered, triple ported VRAM 30 in block diagram form in FIG. 2, as 512 rows×256 columns. Memory portion 42 of the double buffered triple ported VRAM 30, FIG. 2, services vertically partitioned Slice #0 of display 32 and memory portion 44 of the VRAM 30 services Slice #1 of display 32. In this configuration, the VRAMs are allowed to incur 256 consecutive writes without incurring a row change period until the standard horizontal sync period of digital video source 16.

By means of the serial ports of the double buffered VRAM's 30, the parallel write of the reordered pixels from crossbar router 24 to frame buffer 28 is accomplished under the control of subsystem controller 26 which generates VRAM address signals and refresh control signals as a function of horizontal/vertical sync signals 20 from digital video source 16. As shown in FIGS. 1 and 2, when the data bits of the pixels are reconfigured for by bit-plane field and bit-plane row techniques, bit 0 for pixels 0-255, for rows 0-1023 of a first frame is written to Slice #0- Double Buffer #0 of memory portion 42 and a second frame for the same pixels and significant bit is written to Slice #0- Double Buffer #1 of memory portion 42. Likewise, bit 0 for pixels 256-511 for rows 0 through row 1023 is written for the first frame into the memory portion 44 labeled Slice #1- Double Buffer #0 and data for the same pixels and significant bit for the second frame are written in the memory portion 44 designated Slice #1- Double Buffer #1.

Figure 1B:
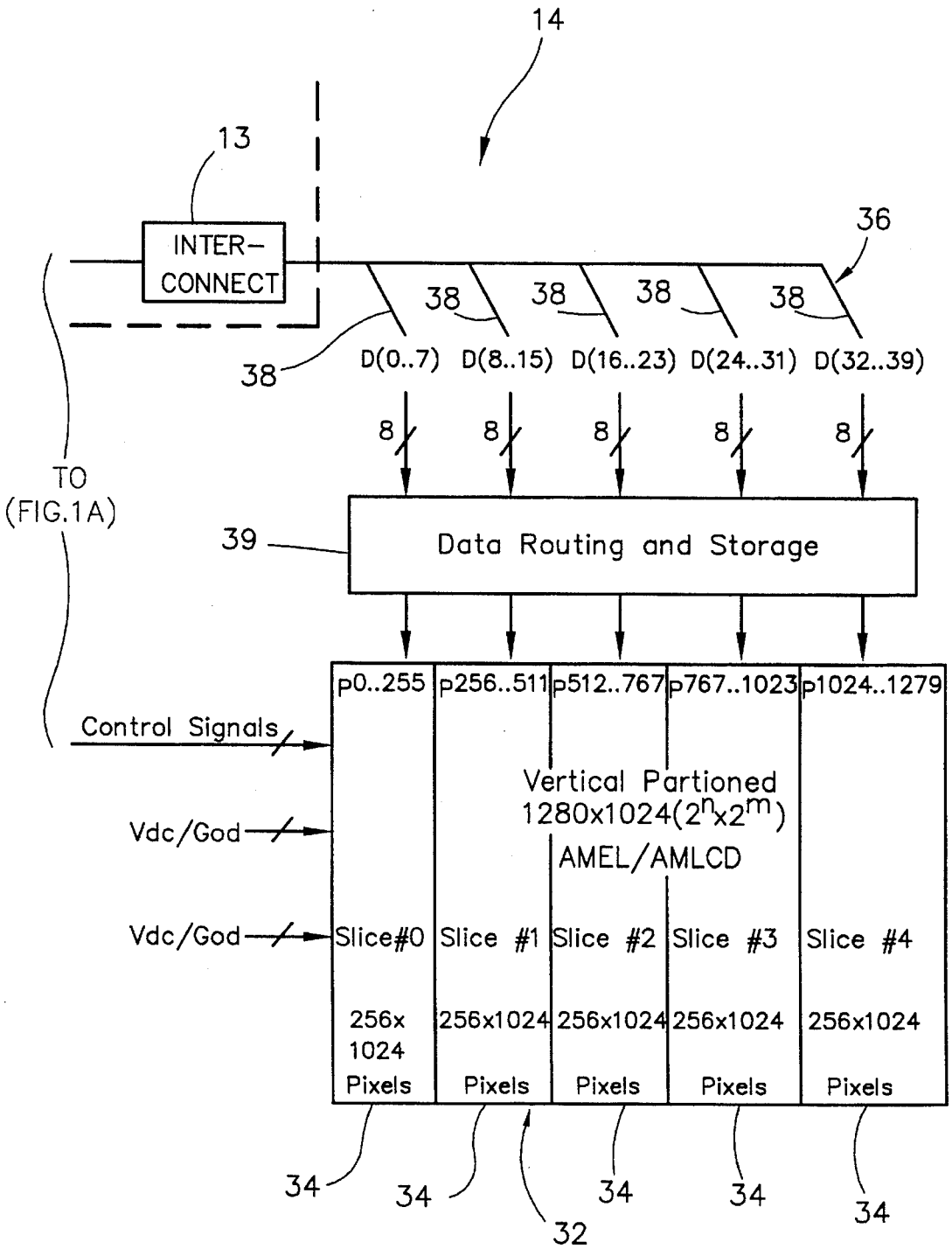
Figure 2:
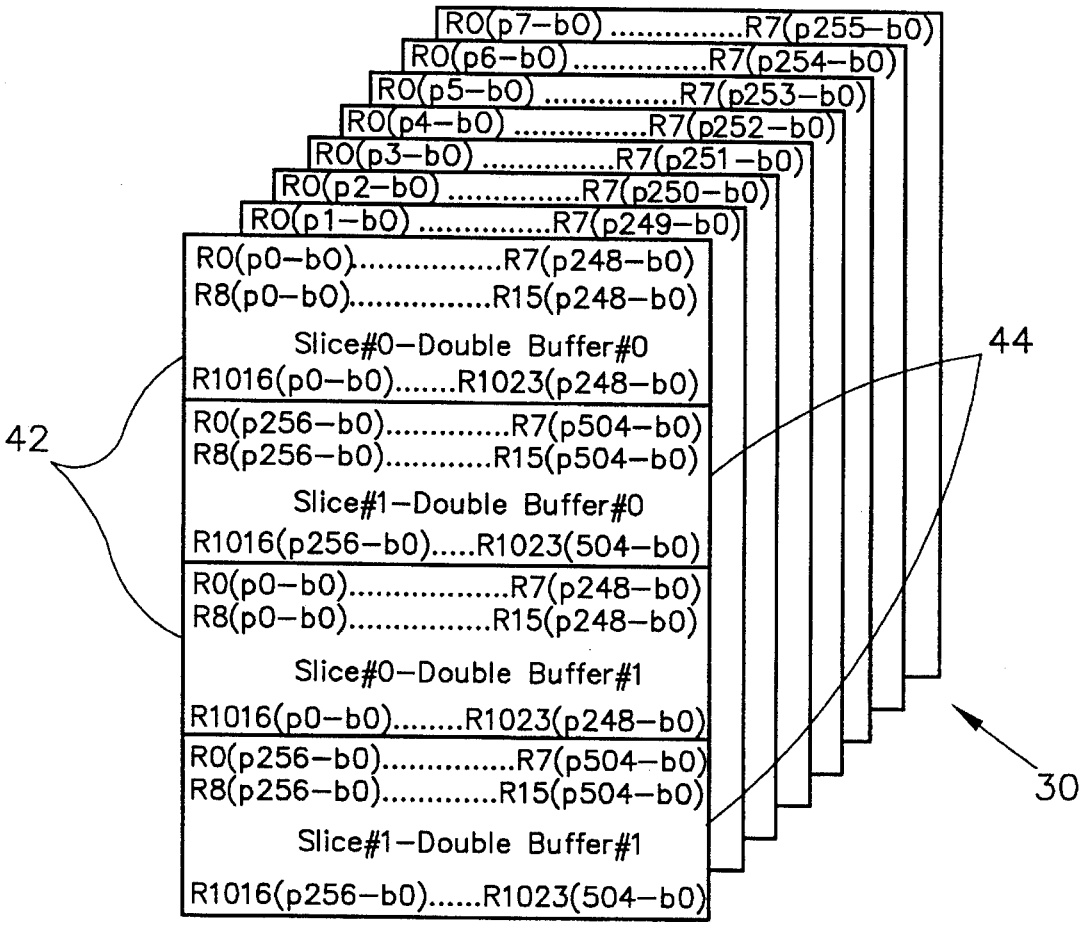
FIG. 2 is a diagram of a double buffered video random access memory of the display system of FIG. 1.

With the frame buffer 28 including twenty-four VRAM's for servicing an 8-bit per pixel display 32, an entire frame, (f), is loaded into the double buffer #0 of VRAM's 30 of frame buffer 28, FIG. 1. The bit 0 is loaded into memory labeled LSB; bit 1 into memory labeled $MSB^{-6}$ and so forth with bit 7, the most significant bit, stored in the memory labeled MSB. Bank #0 (80) stores the bit information for pixels of columns 0-511 of display 32, Bank #1 (81 ) stores the bit information for pixels of columns 512-1023 of display 32, and Bank #2 (82) stores the bit information for pixels of columns 1024-1279 of display 32. If the display included overflow pixels as previously discussed, they would be stored in Bank #2 (82) also. As discussed previously, 8 bits per pixel are transmitted to the display 32. If only 6 bits per pixel were to be transmitted, 6 less VRAM's would be required bringing the total to 18. One skilled in the art will recognize that the number of VRAM's will vary, as the resolution of the display and the number of bits per pixel changes depending upon design choice, and application need for double buffering.

As pixel data is read out of Double Buffer #0 of the VRAM's 30 to display 32 under control of subsystem controller 26, pixel data for a second frame (f+1) is written into Double Buffer #1 of VRAM's 30. Using the double buffering technique eliminates the need to synchronize the input 16 to the output of the VRAM's. If the input and output of the frame buffer 28 were synchronized, the double buffering could be eliminated. Such double buffering and also the VRAM address generation and refresh control signals for control of system 10 vary depending on the display utilized. One skilled in the art can readily discern the timing involved without detailed discussion herein.

The dual serial access memory ports of the VRAM's of Bank #0 (80), generally shown as VRAM outputs 101 and 102, provide for data transmission of pixel data for columns 0-511 of display 32 between frame buffer 28 and partitioned display 32 through the interconnect 13 which is designed based upon the data routing and storage 39 and display 32 being utilized. For bit-plane field technique with MSB first, such as for temporal scale refresh of an AMEL display, VRAM output 101 provides 8 bits of pixel data to group 38 of data lines D(0. . . 7) from frame buffer 28. Likewise, data lines 102, 103, 104, and 105, respectively, service the other four groups 38 of data lines 36 including D(8 . . . 15), D(16 . . . 23), D(24 . . . 31) and D(32 . . . 39). Table 1 shows an example of bit-plane field refresh addressing for transfer of data from frame buffer 28 to data lines 36 during several clock periods and Table 2 shows an example of bit-plane row refresh addressing for such data transfer neglecting a data transfer overhead required and relevant to the design of the data routing and storage 39; each being directly related to the logic required in subsystem controller 26. One skilled in the art will recognize that such order can be changed to meet design needs.

TABLE 1

| clock-row | d(0 . . . 7)slice 0 | d(8 . . . 15)slice 1 | d(16 . . . 23)slice 2 | d(24 . . . 31)slice 3 | d(32 . . . 39)slice 4 |
|---|---|---|---|---|---|
| 0-r(0) | b7(p0 . . . p7) | b7(p256 . . . p263) | b7(p512 . . . p519) | b7(p768 . . . p775) | b7(p1024 . . . p1031) |
| 1-r(0) | b7(p8 . . . p15) | b7(p264 . . . p271) | b7(p520 . . . p527) | b7(p776 . . . p783) | b7(p1032 . . . p1039) |
| . | . | . | . | . | . |
| . | . | . | . | . | . |
| . | . | . | . | . | . |
| 31-r(0) | b7(p248 . . . p255) | b7(p504 . . . p511) | b7(p760 . . . p767) | b7(p1016 . . . p1023) | b7(p1272 . . . p1279) |
| 32-r(1) | b7(p0 . . . p7) | b7(p256 . . . p263) | b7(p512 . . . p519) | b7(p768 . . . p775) | b7(p1024 . . . p1031) |
| 33-r(1) | b7(p8 . . . p15) | b7(p264 . . . p271) | b7(p520 . . . p527) | b7(p776 . . . p783) | b7(p1032 . . . p1039) |
| . | . | . | . | . | . |
| . | . | . | . | . | . |
| . | . | . | . | . | . |
| 63-r(1) | b7(p248 . . . p255) | b7(p504 . . . p511) | b7(p760 . . . p767) | b7(p1016 . . . p1023) | b7(p1272 . . . p1279) |
| 64-r(2) | b7(p0 . . . p7) | b7(p256 . . . p263) | b7(p512 . . . p519) | b7(p768 . . . p775) | b7(p1024 . . . p1031) |
| 65-r(2) | b7(p8 . . . p15) | b7(p264 . . . p271) | b7(p520 . . . p527) | b7(p776 . . . p783) | b7(p1032 . . . p1039) |
| . | . | . | . | . | . |
| . | . | . | . | . | . |
| . | . | . | . | . | . |
| . | . | . | . | . | . |
| . | . | . | . | . | . |
| . | . | . | . | . | . |
| . | . | . | . | . | . |
| 32,735-r(1022) | b7(p248 . . . p255) | b7(p504 . . . p511) | b7(p760 . . . p767) | b7(p1016 . . . p1023) | b7(p1272 . . . p1279) |
| 32,736-r(1023) | b7(p0 . . . p7) | b7(p256 . . . p263) | b7(p512 . . . p519) | b7(p768 . . . p775) | b7(p1024 . . . p1031) |
| 32,737-r(1023) | b7(p8 . . . p15) | b7(p264 . . . p271) | b7(p520 . . . p527) | b7(p776 . . . p783) | b7(p1032 . . . p1039) |
| . | . | . | . | . | . |
| . | . | . | . | . | . |
| . | . | . | . | . | . |
| 32,767-r(1023) | b7(p248 . . . p255) | b7(p504 . . . p511) | b7(p760 . . . p767) | b7(p1016 . . . p1023) | b7(p1272 . . . p1279) |
| 32,768-r(0) | b6(p0 . . . p7) | b6(p256 . . . p263) | b6(p512 . . . p519) | b6(p768 . . . p775) | b6(p1024 . . . p1031) |
| 32,769-r(0) | b6(p8 . . . p15) | b6(p264 . . . p271) | b6(p520 . . . p527) | b6(p776 . . . p783) | b6(p1032 . . . p1039) |

Figure 7:
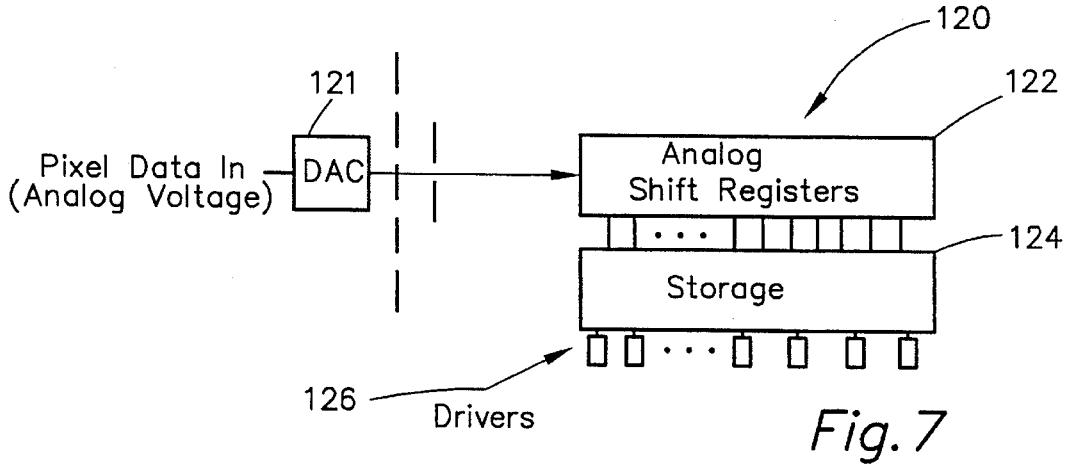
FIG. 7 is a portion of an alternative embodiment of a display system including an analog display apparatus in accordance with the present invention.

Table 1 shows that a bit-plane field of pixel data for bit 7, the most significant bit of one frame (f) of pixel data is transferred to the various data lines 36 and then a bit-plane field of pixel data for bit 6 or $MSB^{-6}$ is transferred. This proceeds until the bit-plane field of pixel data for bit 0 completing an entire frame is transferred. As will be explained below, by transferring the data in this bit-plane field manner, display 32 can be refreshed in a temporal gray scale fashion based upon the luminous characteristics of the display.

apparatus, different interconnects 13 are utilized. For an analog display apparatus, a digital to analog converter 121 is utilized at the memory architecture side of the system to reduce the number of datalines to the analog data routing and storage 120 for a display as shown in FIG. 7. For a digital display apparatus 14, interconnect 13 may include a parallel

TABLE 2

| clock-row | d(0 . . . 7)slice 0 | d(8 . . . 15)slice 1 | d(16 . . . 23)slice 2 | d(24 . . . 31)slice 3 | d(32 . . . 39)slice 4 |
|---|---|---|---|---|---|
| 0-r(0) | b7(p0 . . . p7) | b7(p256 . . . p263) | b7(p512 . . . p519) | b7(p768 . . . p775) | b7(p1024 . . . p1031) |
| 1-r(0) | b7(p8 . . . p15) | b7(p264 . . . p271) | b7(p520 . . . p527) | b7(p776 . . . p783) | b7(p1032 . . . p1039) |
| . | . | . | . | . | . |
| . | . | . | . | . | . |
| . | . | . | . | . | . |
| 31-r(0) | b7(p248 . . . p255) | b7(p504 . . . p511) | b7(p760 . . . p767) | b7(p1016 . . . p1023) | b7(p1272 . . . p1279) |
| 32-r(0) | b6(p0 . . . p7) | b6(p256 . . . p263) | b6(p512 . . . p519) | b6(p768 . . . p775) | b6(p1024 . . . p1031) |
| 33-r(0) | b6(p8 . . . p15) | b6(p264 . . . p271) | b6(p520 . . . p527) | b6(p776 . . . p783) | b6(p1032 . . . p1039) |
| . | . | . | . | . | . |
| . | . | . | . | . | . |
| . | . | . | . | . | . |
| 63-r(0) | b6(p248 . . . p255) | b6(p504 . . . p511) | b6(p760 . . . p767) | b6(p1016 . . . p1023) | b6(p1272 . . . p1279) |
| 64-r(0) | b5(p0 . . . p7) | b5(p256 . . . p263) | b5(p512 . . . p519) | b5(p768 . . . p775) | b5(p1024 . . . p1031) |
| 65-r(0) | b5(p8 . . . p15) | b5(p264 . . . p271) | b5(p520 . . . p527) | b5(p776 . . . p783) | b5(p1032 . . . p1039) |
| . | . | . | . | . | . |
| . | . | . | . | . | . |
| . | . | . | . | . | . |
| . | . | . | . | . | . |
| . | . | . | . | . | . |
| . | . | . | . | . | . |
| 223-r(0) | b1(p248 . . . p255) | b1(p504 . . . p511) | b1(p760 . . . p767) | b1(p1016 . . . p1023) | b1(p1272 . . . p1279) |
| 224-r(0) | b0(p0 . . . p7) | b0(p256 . . . p263) | b0(p512 . . . p519) | b0(p768 . . . p775) | b0(p1024 . . . p1031) |
| 225-r(0) | b0(p8 . . . p15) | b0(p264 . . . p271) | b0(p520 . . . p527) | b0(p776 . . . p783) | b0(p1032 . . . p1039) |
| . | . | . | . | . | . |
| . | . | . | . | . | . |
| . | . | . | . | . | . |
| 255-r(0) | b0(p248 . . . p255) | b0(p504 . . . p511) | b0(p760 . . . p767) | b0(p1016 . . . p1023) | b0(p1272 . . . p1279) |
| 256-r(1) | b7(p0 . . . p7) | b7(p256 . . . p263) | b7(p512 . . . p519) | b7(p768 . . . p775) | b7(p1024 . . . p1031) |
| 257-r(1) | b7(p8 . . . p15) | b7(p264 . . . p271) | b7(p520 . . . p527) | b7(p776 . . . p783) | b7(p1032 . . . p1039) |

Table 2 shows that a bit-plane row of pixel data for row 0 including bit 7 through bit 0, of one frame (f) of pixel data is transmitted to the various data lines 36 and then a bit-plane row of pixel data for row 1 is transmitted. This proceeds until pixel data for row 1023 is transferred completing transfer of an entire frame.

The number of data lines 36 are chosen as a function of the number of columns of pixels of each pixel slice of partitioned display 32 and the technology, whether analog or digital, of data routing and storage 39. The number of data lines in each group 38 of data lines 36 for each pixel slice is evenly divisible into the number of columns of pixels of the pixel slice. The groups 38 of data lines 36 are input to data routing and storage circuitry 39. Such data routing and storage 39 may take many forms depending upon design techniques and the image display being utilized. For example, as shown in FIG. 1 for a digital display apparatus 14, eight data lines $2^3$, is evenly divisible into 256 columns. Such selection as a function of $2^z$, where z is an integer, facilitates matching of the VRAM's organization to the pixel slice organization, reduces the number of VRAM's necessary and increases the data transmission rate. On the other hand, for an analog display apparatus, a single input line would service each vertical pixel slice as will be described further below with reference to FIG. 7.

It is only necessary that the pixel data input by data lines 36 be routed to the correct pixel location of the display for activation thereof. Interconnect 13 is necessary to provide a feasible physical manner of getting pixel data from the reconfigurable graphics memory 12 to the display apparatus 14. Depending upon the technology utilized for the display to serial conversion at the memory architecture 12 side of the display system and then a serial to parallel conversion at the display apparatus 14 side of the display system. The physical transmission lines and interconnect may utilize fiber optics to reduce size limitations.

By utilizing a vertically partitioned display 32 and allocated data lines for the partitioned slices, transmission of pixel data to the pixel slices at desired data rates, with a minimum of VRAM devices 30 is accomplished. Matching the vertical partitioning and maintaining an interconnect commonality with standard VRAM's organized as $2^x$ columns by $2^y$ rows and a plurality of bits deep, with x and y being integers, provides such capabilities. As shown in FIG. 1, with standard VRAM's organized as 512 rows×256 columns, a 1280×1024 pixel display is partitioned into five pixel slices, each vertical pixel slice being $2^8 \times 2^{10}$ or 256×1024. The 256 columns of each vertical slice matches the 256 column organization of the standard VRAM. With the selection of 8 data lines ($2^3$) for each pixel slice 34, efficient transfer rates and reduction in display interconnect are accomplished. Generally, the partitioning can be written as $q(2^n \times 2^m)$=# pixels, where q=# of slices, n=horizontal or column pixel power, and m=vertical or row pixel power. The number of pixels of each slice reflect a function of 2 just as the standard VRAM is organized as a function of 2.

Figure 8A:
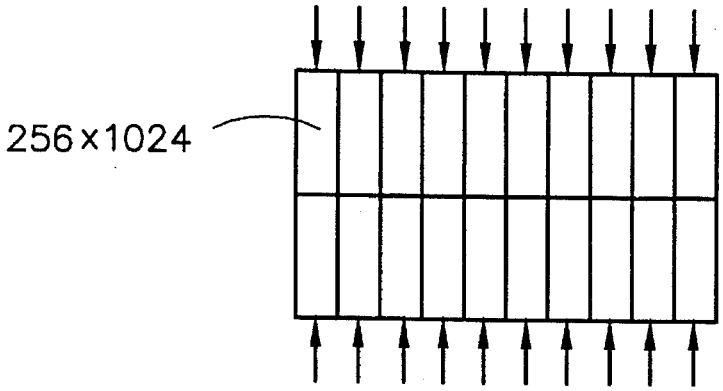
FIGS. 8A–8D are block diagrams of various manners to partition a high resolution image display.
Figure 8B:
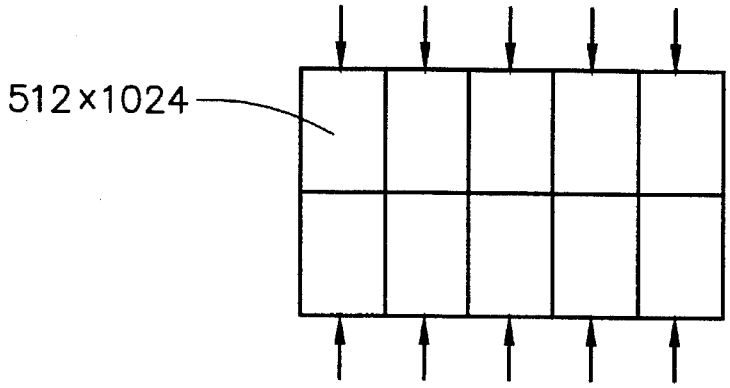
Figure 8C:
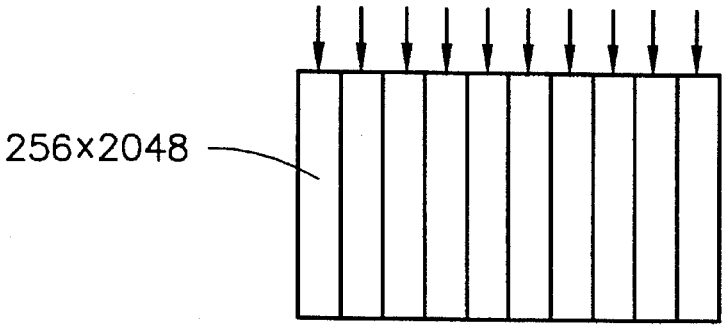
Figure 8D:
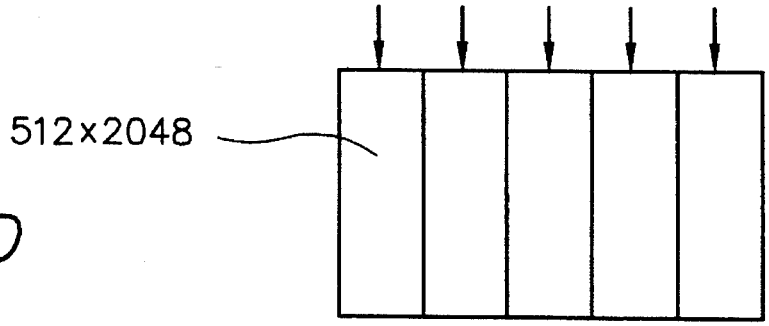

With partitioning in this manner, growth in resolution is allowed as technology advances. For example, a 2560×2048 image display can be partitioned in a number of ways as shown in FIG. 8A–8D. In FIG. 8A, the 2560×2048 image display is organized as $20(2^8 \times 2^{10})$ equal to 5,242,880 pixels. Each pixel slice is organized as 256×1024 pixels and the image display includes 20 sets of data input lines. As shown in FIG. 8B, the image display is partitioned in accordance with $10(2^9 \times 2^{10})$ which is equal to 5,242,880 pixels. Each pixel slice is organized as 512×1024 pixels and 10 sets of pixel data lines provide the data thereto. Also, as shown in FIG. 8C, the image display could be partitioned in accordance with $10(2^8 \times 2^{11})$ equal to 5,242,880 pixels. The pixel slices would then be organized as 256×2048 with 10 sets of data lines providing the data thereto. Lastly, as shown in FIG. 8D, the image display is partitioned in accordance with $5(2^9 \times 2^{11})$ equal to 5,242,880 pixels. Each pixel slice is organized as 512×2048 which is four times the partitioning utilized for display 32, the 1280×1024 display. Five sets of data lines are then utilized to provide the data thereto. These multiple manners of partitioning a 2560×2048 image display are performed without concern for the image display technology or driver designs developed. As such, the partitioning is applicable to AMLCD's, AMEL displays, FEA displays, and other display technologies.

Figure 3:
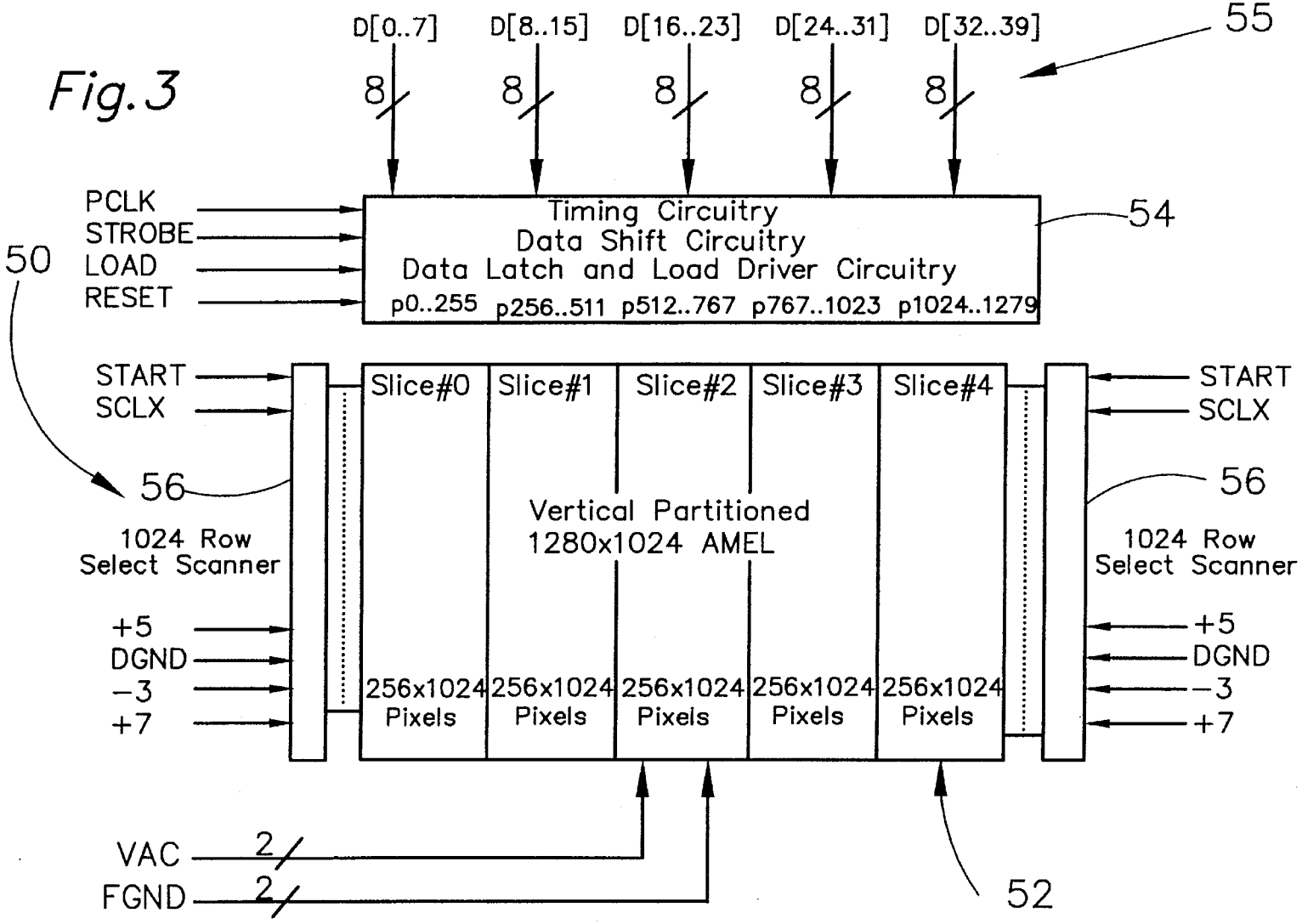
FIG. 3 is one embodiment of a digital display apparatus of the display system of FIG. 1.
Figure 4:
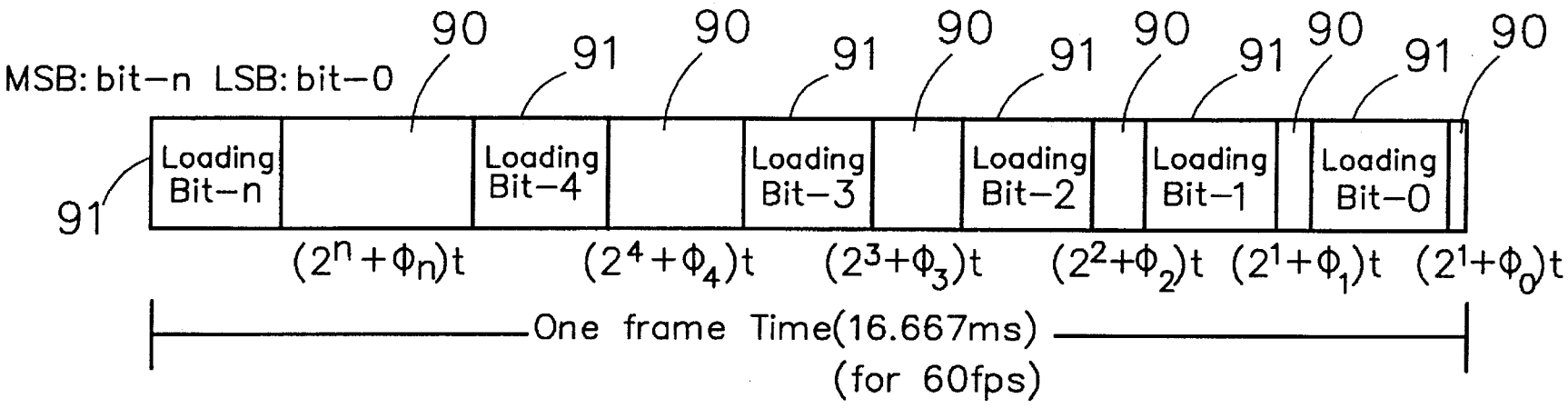
FIG. 4 is a diagram showing frame timing for temporal gray scale loading of digital data to pixels for display.

With reference to FIGS. 3 and 4, display apparatus 50, one embodiment of a digital display apparatus 14 shall be described in further detail. The 1280×1024 AMEL display 52 of display apparatus 50 is segmented or partitioned into five vertical slices, Slices #0–#4. The size of the slices is determined as a function of the organization of the VRAM's 30 as previously described. Because the VRAM devices are organized as $2^n$ rows by $2^m$ columns, the size of the slices is selected as function of 2, i.e. each slice being 256×1024 pixels. Each of the vertically partitioned slices, Slices #0–#4, are serviced by 8 data lines 55, including data line groups D(0 . . . 7), D(8 . . . 15), D(16 . . . 23), D(24 . . . 31), and D(32.39), for a total of 40 data lines. For example, Slice #0 is serviced by data lines D[0 . . . 7]. Each group of data lines provide pixel data to data routing and storage circuitry 54 which comprises a 32-stage shift register and 256 data latches for each group of data lines 50. For a bit-plane field, there are 1280 bits of data stored in the shift registers through the 40 data inputs. These databits are written into one row of 1280 pixels by way of the 256 data latches and driver circuitry for each group of inputs.

To effect temporal gray scale, row selection by 1024 row select scanner 56 under control of subsystem controller 26 is progressed sequentially until all 1024 rows have been selected to completely load a field or one of the eight bit-plane fields of data; the eight bit-plane fields of data constituting a frame of an eight-bit gray scale image. In other words, the 40 data lines 55 transmit a one bit-plane field of 1280×1024 bits of data into the display via data routing and storage circuitry 54.

With a fixed, 10 kHz, AC frequency for electroluminescent illumination, the timing of digital data loading and electroluminescent illumination for temporal gray scale of AMEL display 52 is shown in FIG. 4. Total illumination time required for the display is the summation of time periods represented by the shaded areas 90. The blocks 90 represent the time frame for electroluminescent illumination during which no digital data is loaded to the pixels. The remainder of the time after subtracting the total illumination time from the total time required for one frame loading and illumination is equal to the time left to load the digital data to the pixels between illuminations. In one method of temporal gray scale, the most significant bit-plane is loaded followed by the longest illumination time. Thereafter, each bit-plane of less significance is loaded followed by a shorter illumination time for each bit-plane. Generally, with n bits per pixel, as shown in FIG. 4, the illumination time per bit plane is $(2^l+\phi_n)t$ where t=basic illumination time and $\phi_n$ is the image display non-linearity adjustment.

As an example, for 60 fps, the single frame time is 16.667 ms. The total illumination time required is equal to about 7.1 ms which allows at most 9.566 ms for loading all 6 bit-planes represented generally by blocks 91. A row of pixel data in a bit-plane field (1280 bits) must then be loaded within at least 1.456 μs. Thirty-two data writes occur during the loading of one row of pixel data resulting in approximately 22 million write operations per second. Data write operations are performed on both the falling and rising edges of pixel clock, PCLK; therefore, PCLK minimum is one-half the write operation rate or about 11 MHz. One skilled in the art will recognize that the rates and frequencies used herein are only examples and that with the consideration of alternative frame rates and overhead that other frequencies are contemplated in accordance with the present invention.

A START signal begins each field or bit-plane of data loading. The falling edge of the START signal is synchronized with the falling edge of SCLK. Thirty-two (32) writes are performed during each consecutive SCLK, which is the row select scanner clock signal, with the LOAD signal transitioning to a "high" state to indicate completion. The SCLK cycle is comprised of 18 PCLK cycles of which 16 are used to perform the thirty-two (32) writes to a row of pixels of the display. The remaining two PCLK cycles are used for LOAD and STROBE signals, respectively. The LOAD signal writes the 1280 bits of pixel data into the corresponding pixel row, while the STROBE signal begins transmission of another row of pixel data. The rising edge of strobe occurs one PCLK cycle after LOAD and is also completed within a PCLK cycle. With the strobe pulse repeated 1024 times to complete the storage of a one bit-plane or field of data to the display pixel area, a reset pulse resets all the pixel data lines to ground potential prior to the application of a high voltage sinusoidal waveform to the electroluminescent common electrodes of the electroluminescent display as is known in the art. The length of the display illumination depends upon the bit weight of the field data, as shown in FIG. 4. The timing of the RESET signal is related to the timing at the end of the last shift register output or 1024th row of the select scanner. One skilled in the art will recognize that the above description includes standard timing operations and therefore shall not be explained in any further detail.

Figure 5:
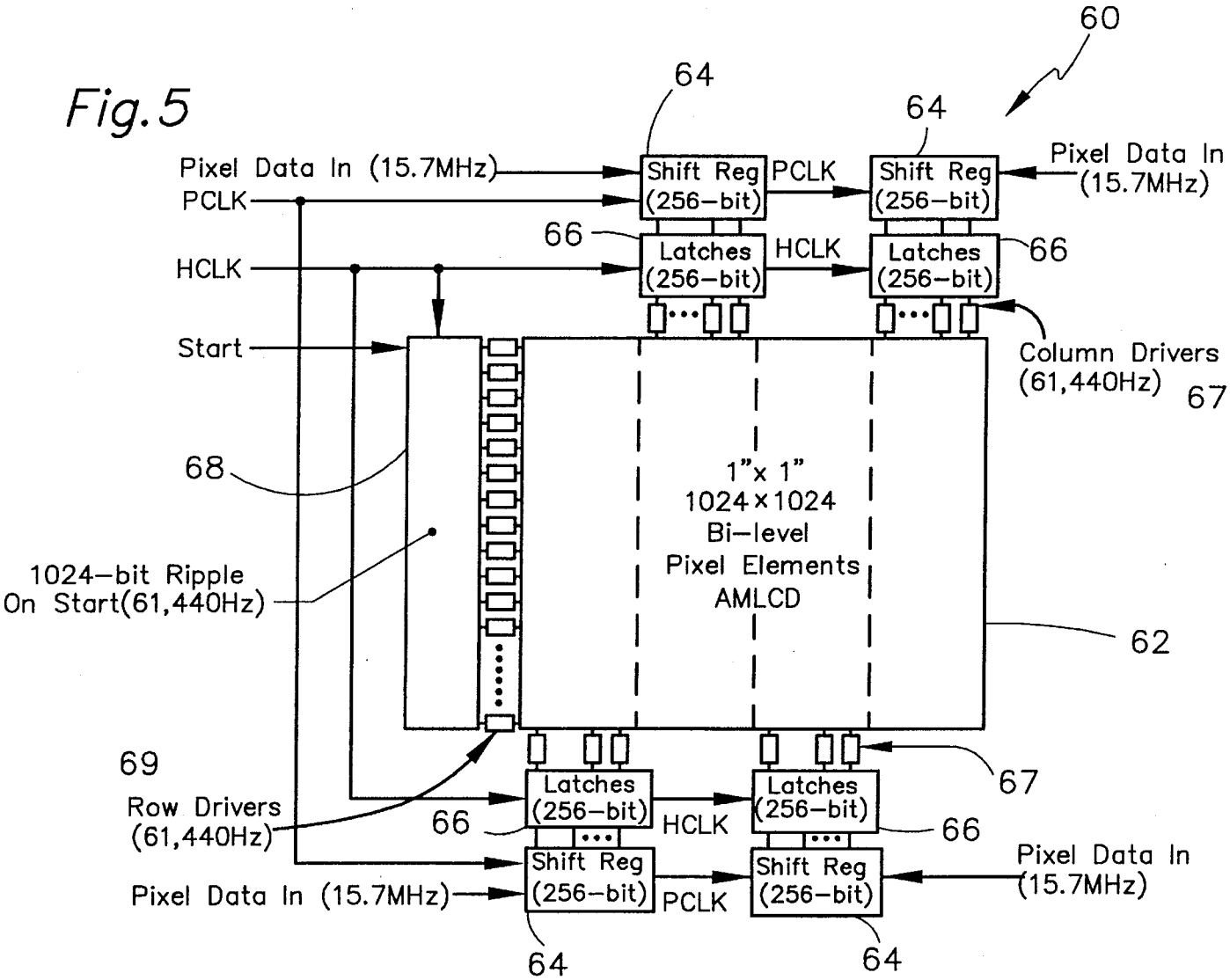
FIG. 5 is an alternative embodiment of a display apparatus of the display system of FIG. 1.
Figure 6:
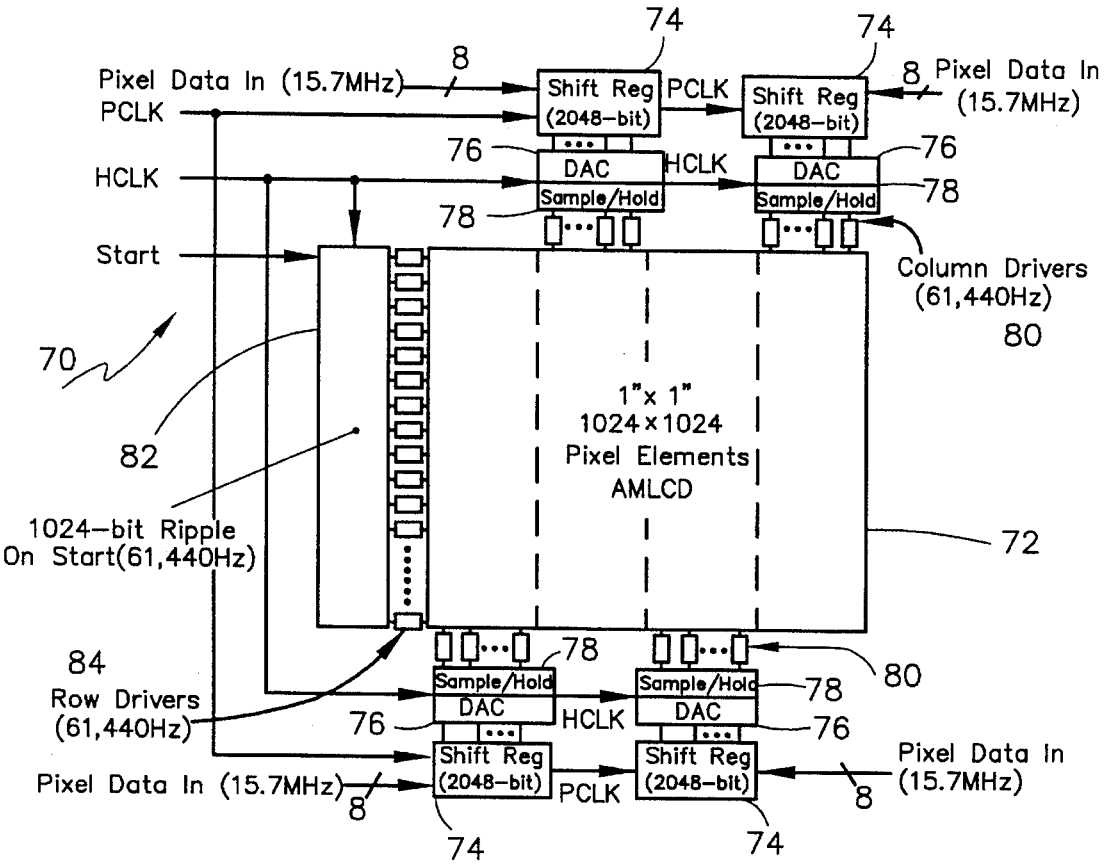
FIG. 6 is an alternative embodiment of a display apparatus of the display system of FIG. 1.

Alternative embodiments of the present invention are shown in FIGS. 5–7. The detailed description above is provided with regard to the digital AMEL display apparatus 50. However, partitioning a display in accordance with the present invention is also applicable to AMLCD's, in addition to other displays such as FEA displays and charge transfer type displays. Both analog and digital display apparatus can be utilized. Digital configurations are shown in FIGS. 5 and 6 with an analog data routing and storage shown in FIG. 7. Many various combinations of designs are possible with use of partitioning in accordance with the present invention and as set forth in the accompanying claims.

FIG. 5 shows a digital display apparatus 60 including a 1024×1024 hi-level pixel elements AMLCD display 62. The display 62 is vertically partitioned into four pixel slices. Each pixel slice is serviced by one data line for inputting of pixel data at a rate of 15.7 MHz based on a 60 fps refresh rate. The pixel slices are organized as 256×1024. A data line is provided to each 256 bit shift register 64 with one shift register 64 servicing each of the pixel slices of display 62. The pixel data is then stored in the 256-bit latches 66, one for each pixel slice, prior to loading the pixel data to the AMLCD pixel elements via column drivers 67. As the AMLCD 62 is a bi-level device, the pixel data for the 1024 rows of pixels are loaded sequentially under control of a 1024 row select scanner 68 and row drivers 69. As such, each of the 1024 rows is sequentially activated for completion of loading one frame. Pixel and horizontal clock signals, PCLK and HCLK, respectively, along with the START signal provide the timing necessary for such loading and scanning circuitry. The vertical partitioning of the AMLCD device 62 with parallel loading of data thereto results in a column driver rate capable of operating at rates necessary for high resolution displays.

FIG. 6 shows an AMLCD display apparatus 70 including a vertically partitioned AMLCD device 72. The AMLCD 72 is vertically partitioned into four pixel slices, each organized as 256 by 1024. The pixel data is input via 8 data lines to a 2048 bit shift register 74. Each vertical slice is serviced by one such shift register 74. The shift register 74 is capable of handling pixel data for an 8-bit gray scale level. The pixel data of the 2048 bit shift register is then converted to an analog signal stored by sample and hold 78. Column drivers 80 drive the particular corresponding pixels of the rows selected via row drivers 84 and 1024 bit ripple row select scanner 82. The pixel and horizontal clock signals, PCLK and HCLK, respectively, and the START signal supply the timing for loading the data in parallel to the vertically partitioned slices of the AMLCD 72.

FIG. 7 shows data routing and storage circuitry 120 for one vertical slice of an analog display apparatus. An analog voltage is provided by one data line for each vertical slice of a vertically partitioned analog display, the pixel data being converted by a digital to analog converter 121 which is part of the interconnect between the memory configuration and display apparatus. Analog shift registers 122, storage 124, and drivers 126 for each vertical pixel slice provide the data to the pixel slices for activation of the corresponding pixels selected in a sequential row fashion. Such interconnect and data routing and storage can be used with AMEL displays, AMLCD's or any other displays.

Those skilled in the art will recognize that only preferred embodiments of the present invention have been disclosed herein, that other advantages may be found and realized, and that various modifications may be suggested by those versed in the art. It should be understood that the embodiments shown herein may be altered and modified without departing from the true spirit and scope of the invention as defined in the accompanying claims.

I claim:

1. A partitioned display apparatus for displaying video information received from a plurality of memory devices, each memory device organized as $2^x$ rows by $2^y$ columns of memory locations and a plurality of bits deep, where x and y are integers, said display apparatus comprising:

a plurality of memory means for storing data representing at least one pixel slice array coupled to a digital video input;

a fault-tolerant cross bar routing switch means coupled to the plurality of memory devices for switching a video output representing the at least one pixel slice array from the plurality of memory means to a VRAM matrix configured to match said pixel slice array;

a graphical image source memory subsystem controller coupled to the plurality of memory devices and the video output from the cross bar routing switch means so that the video input, the pixel slice array, a plurality of addressing data, and a plurallity of control signals cooperate to produce a rapidly updated high resolution image on a visual display means, wherein the visual display means comprises a plurality of display slices, each display slice including a plurality of pixels, at least one of the display slices organized as $2^n$ rows by $2^m$ columns of pixels as a function of the memory means, where n and m are integers; and means for receiving the video information from the plurality of memory devices and driving at least a portion of said plurality of pixels of said each display device in parallel.

2. An apparatus according to claim 1, wherein said receiving means receives a one bit-plane field of video information via a plurality of groups of at least one data input, one group of at least one data input for each display device, said groups being utilized in parallel.

3. An apparatus according to claim 1, wherein said receiving means receives a bit-plane row of video information via at least one data input for each display device, said data inputs utilized in parallel.

4. An apparatus according to claim 1, wherein said receiving means receives the video information in raster fashion via a data input for each display device, said data inputs utilized in parallel.

5. An apparatus according to claim 1, further including interconnect means for transmission of video information from said plurality of memory devices to said plurality of display devices via transmission medium.

6. An apparatus according to claim 5, wherein said interconnect means includes a digital to analog converter at said plurality of memory devices for conversion of video information prior to transmission.

7. An apparatus according to claim 5, wherein said interconnect means includes a parallel to serial converter at said plurality of memory devices prior to transmission and a serial to parallel converter at said plurality of display devices after transmission.

* * * * *